United States Patent [19]

Ecklund

[11] Patent Number: 4,688,254

[45] Date of Patent: Aug. 18, 1987

[54] CONTROLLED BLEND FOR AM STEREO RECEIVERS

[75] Inventor: Lawrence M. Ecklund, Wheaton, Ill.

[73] Assignee: Motorola, Inc., Schaumburg, Ill.

[21] Appl. No.: 846,775

[22] Filed: Apr. 1, 1986

[51] Int. Cl.[4] ..... H04H 5/00

[52] U.S. Cl. ..... 381/15; 381/10

[58] Field of Search ..... 381/15, 16, 2, 13, 10

[56] References Cited

U.S. PATENT DOCUMENTS

| | | | |
|---|---|---|---|
| 4,218,586 | 8/1980 | Parker et al. | 381/16 |
| 4,371,747 | 2/1983 | Hilbert | 381/15 |
| 4,375,580 | 3/1983 | Sauer | 381/15 |
| 4,379,208 | 4/1983 | Isbell et al. | 381/15 |
| 4,430,747 | 2/1984 | Streeter | 381/15 |

*Primary Examiner*—Forester W. Isen

*Attorney, Agent, or Firm*—Margaret Marsh Parker

[57] ABSTRACT

A control circuit in an AM stereophonic receiver examines a detected signal for occurrences of overmodulation and, when a first given level of overmodulation is reached, begins to turn down the correction signal used in the demodulation and, if overmodulation continues, would eventually eliminate the correction signal. At a second given level of overmodulation, the circuit will begin to attenuate the stereo difference signal from the receiver output and eventually eliminate it. When the overmodulation is reduced, operating conditions return toward normal.

16 Claims, 3 Drawing Figures

CONTROLLED BLEND FOR AM STEREO RECEIVERS

BACKGROUND OF THE INVENTION

This invention relates to AM stereophonic reception and, more particularly, to the provision of a gradual blend function in response to certain signal conditions.

In the AM stereophonic system with which this invention was designed to function, the transmitted and received signal can be represented by the following formula:

$$(1+L+R)\cos(w_c t+\phi)$$

where L and R are information signals, w represents the carrier frequency and $\phi$ is the angle whose tangent is $[(L-R)/(1+L+R)]$. This signal and the system employing it are described in U.S. Pat. No. 4,218,586, assigned to the same assignee, and incorporated herein by reference. For purposes of the present invention, it is only necessary that the signal as received and detected requires the use of a correction signal in order to restore the original L and R signals. L and R, it will be understood, represent any two information signals which it is desired to transmit on one carrier signal. In common usage they represent left and right stereophonic signals such as would be produced by two separated microphones or the like.

In the prior art, particularly in the field of FM stereo reception, there are many different circuits for providing a change from stereophonic to monophonic reception when the received signal is less than satisfactory. In FM broadcasting, the need for a blend function arises, for example, when the transmitted signal is severely affected by multipath reception or by interference from other stations, becoming exceptionally noisy and/or distorted. Since FM stereo signals inherently suffer a 23 db degradation as compared to monophonic signals, a weak signal having a significant amount of noise would make monophonic reception more desirable than stereo. In U.S. Pat. No. 3,825,697, a blend control signal is derived by examining the phase error between the 38 kHz demodulating signal and the 19 kHz pilot signal, the control signal establishing a connection between the L and R output terminals when the phase error exceeds a predetermined value. The control signal provides for a rapid change to monophonic operation and a gradual change back to stereophonic operation.

In another patent, U.S. Pat. No. 4,379,208, a blend control is combined with an AM stereo pilot signal indicator in a receiver wherein blending is a function of loss of pilot signal, receiver mistuning, or an excessively weak received signal.

SUMMARY OF THE INVENTION

An object of this invention is to provide signals of the best possible quality in an AM stereophonic receiver, especially under less than optimum signal conditions.

A more particular object is to optimize the signals with changes which are minimally perceptible to he listener.

Still another object is to provide such signals with the minimum of elements and in form adaptable to integrated circuit implementation.

These objects and others are made possible in accordance with the present invention by means of a circuit which examines the in-phase signal for evidence of overmodulation in the downward direction. When a first predetermined level of overmodulation is reached, the correction signal which eliminates the cosine factor in the received signal is reduced, and finally phased out completely. If the level of overmodulation increases beyond a second predetermined value, the (L−R) signal is gradually reduced also. In the extreme case, the (L−R) signal is completely eliminated, leaving an uncorrected monophonic signal, the optimum signal under such circumstances. As the received signal improves, the process is reversed gradually with minimum perceptibility for the listener.

DETAILED DESCRIPTION OF THE PREFERRED EMBODIMENT

Figure 1:
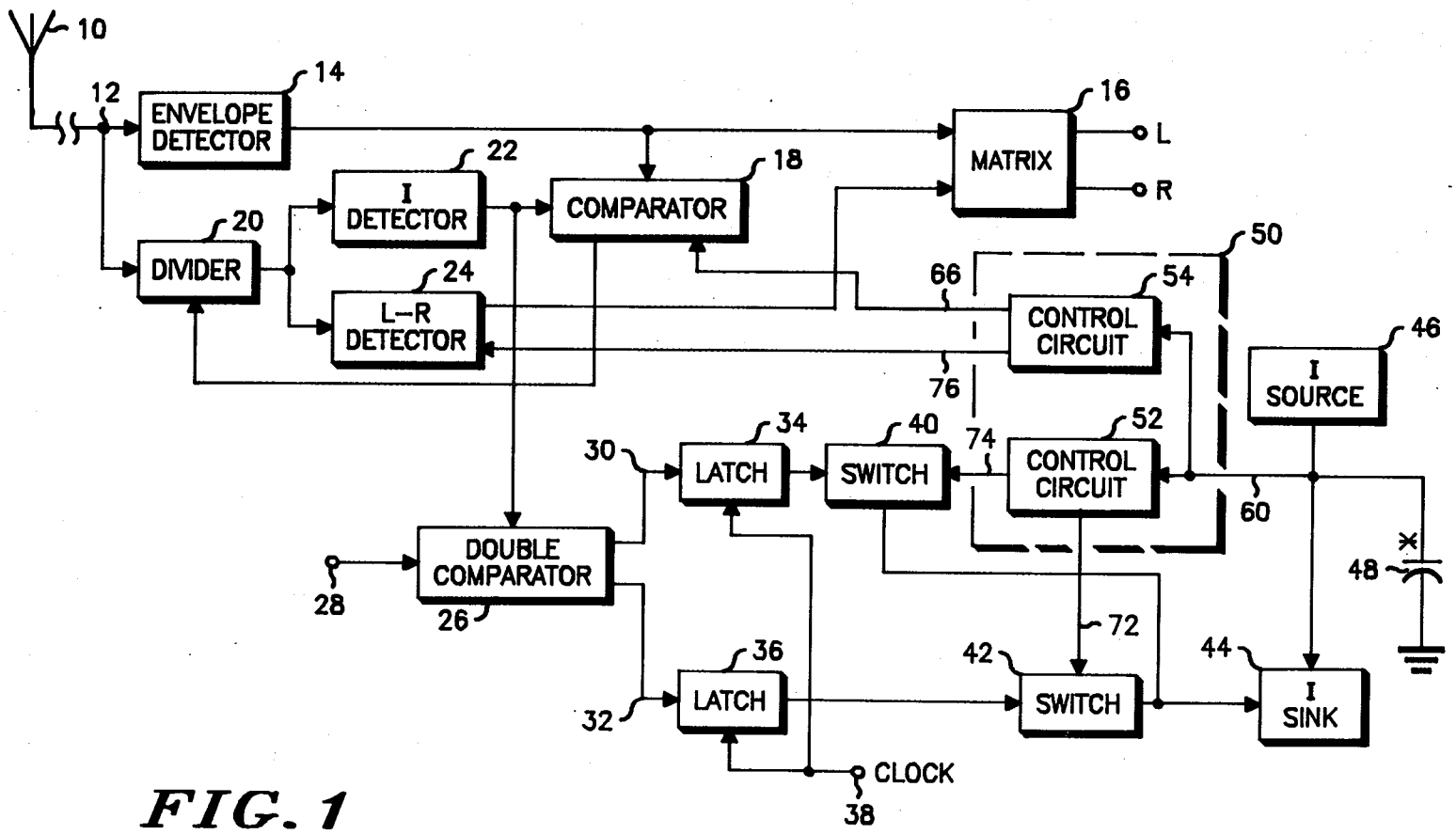
FIG. 1 is a block diagram of an embodiment of the invention.

The block diagram of FIG. 1 represents a portion of an exemplary AM stereophonic radio receiver wherein a broadcast signal is received at an antenna 10. Portions of this receiver are the equivalent of portions of a receiver of U.S. Pat. No. 4,371,747, assigned to the assignee of the present invention. Neither the receiver shown nor the particular signal used therein are to be considered as limiting the present invention. As mentioned hereinabove, the signal received by the receiver shown here can be represented by the following formula:

$$(1+L+R)\cos(w_c t+\phi)$$

where L and R are information signals, w represents the carrier frequency and $\phi$ is the angle whose tangent is $[(L-R)/(1+L+R)]$. The RF signal is detected, mixed and amplified in normal fashion (RF/IF/mixer stages not shown). The IF signal is coupled to an envelope detector 14 whose output is 1+L+R, the normal monophonic signal. This output signal is coupled to a matrix 16 and to a comparator 18. The IF signal is also coupled to one input of a divider 20 which receives the output of the comparator 18 at a second input. The divider 20 performs the cosine correction function as will be seen. The divider output is coupled to an in-phase (I) detector 22 whose output goes to a second input of the comparator 18. In the comparator 18, the envelope signal is compared with the in-phase signal, and the difference between the signals, the "error", is the cosine correction signal. The correction signal, when coupled back to the divider 20, causes the output of the divider to be "corrected". The term "correction", as it applies to this exemplary receiver, means that the factor "cosine $\phi$" has been removed from the output signals of the divider 20. This correction function is controllable in accordance with the invention, as will be shown hereinbelow.

The divider 20 output is also coupled to an input of an L−R (or Q) detector 24. The in-phase (I) detector 22 and the quadrature (Q) detector 24 would be synchronous detectors or the equivalent, as is known. The normal, corrected output of the L−R detector 24 is L−R, and this signal is coupled to the matrix 16. As is known, the normal outputs of the matrix are L and R, the two original information signals.

The output signal of the I detector 22 is also coupled to a second comparator 26 having a second or reference input 28. The input signal at the reference input is equal to the DC level of zero carrier at the I detector. The comparator 26 is a dual output comparator which compares the input signal I with the reference input signal and provides a first output signal at a terminal 30 only when there is more than 4% negative overmodulation. Since as is known, a transmitter is almost never overmodulated in the downward direction (which would cause distortion), negative overmodulation is an indication of noise, interfering signals, etc. Overmodulation can occur for several reasons such as noise or interfering signals. If the signal I reaches the 10% overmodulation level, a second output signal is provided at a second output terminal 32. The output signals from the dual comparator 26 are, therefore, made up of short "blips", one for each time a reference level is exceeded. The output signal at the terminal 30 is coupled to a latch circuit 34, which creates a relatively long pulse for each blip from terminal 30. The output signal at the terminal 32 is coupled to a latch 36, also for providing long pulses. Each of the latches 34,36 is clocked or reset from a low frequency clock pulse source 38. In this embodiment, the clock could be a 25 Hz pilot signal which is available in the receiver. In other applications of this invention, any suitable low frequency signal could serve as the clock signal input.

The output signal from the latch 34 is coupled through an electronic switch 40. The output signal from the latch 36 is coupled through another electronic switch 42. The output of the switch 40 and the output of the switch 42 are combined to control a current sink or "pull-down" circuit 44. The current sink is coupled to a current source or "pull-up" circuit 46, and the interconnection of the two is coupled to a "blend" capacitor 48. The other end of the capacitor is coupled to ground or other reference level. It can now be seen that each output pulse or blip from the comparator 26 causes a slight discharge of the blend capacitor 48. Since there is a small, steady current supplied to restore the charge on the capacitor, the average voltage is an indication of the quality of the received signals. The supplied current might be, for example, 0.001 ma and each discharge pulse 0.5 ma.

The voltage on the blend capacitor 48 is coupled to a control circuit 50 (see FIG. 3) functionally comprised of two parts 52 and 54. Control circuit portion 52 is preferably a digital control, and has two outputs which are coupled back to control the switches 40,42. The switch 40 is opened when the voltage on the blend capacitor 48 is lowered to a first predetermined level and the switch is closed again when the capacitor voltage rises above the first level. If the capacitor voltage is lowered to a second predetermined level, the switch 42 is opened, disconnecting the latch 36 until the voltage on the blend capacitor 48 increases sufficiently to close the switch 42. This type of operation will continue until modulation returns to normal. In this embodiment, the voltage on the capacitor 48 cannot be allowed to decrease indefinitely since other functions in the receiver are also coupled to the capacitor voltage and would be undesirably affected by extremely low voltages. Switches 40,42 maintain a minimum level of voltage on the capacitor 48.

The control circuit portion 54 is preferably a linear type of control, having two outputs, each responsive to a different voltage on the capacitor 48. The relative voltage values are discussed with respect to FIG. 2. One output is coupled to a control input of the comparator 18 where it turns down, and possibly off, the cosine $\phi$ signal being coupled back to the divider 20. The second output is coupled to the L−R detector 24, and can turn down and off the L−R signal being coupled to the matrix. Thus, as the amount of overmodulation increases, first the amount of correction will be reduced until it is turned completely off, then the difference signal L−R will be gradually reduced, then turned off. At this last point, the operating mode of the receiver has been almost imperceptibly changed from "corrected" to "uncorrected" and from stereophonic to monophonic. Each of these various operating modes produces the optimum output signals for the corresponding received signals.

Figure 2:
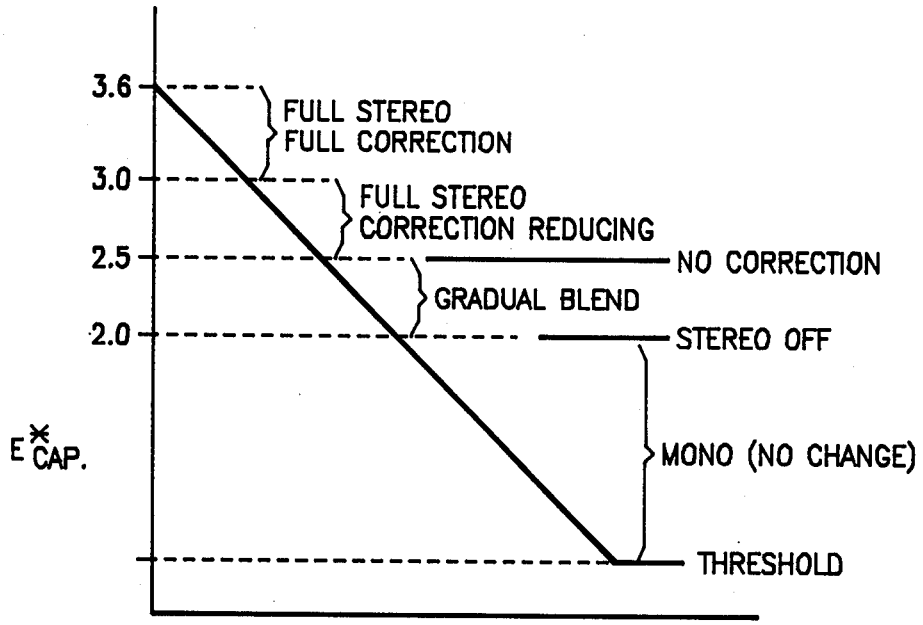
FIG. 2 is a chart of control voltages relating to the diagram of FIG. 1.

The chart of FIG. 2 illustrates the operation in terms of the voltage on the blend capacitor 48 in this embodiment. For clarity, the chart illustrates essentially a laboratory condition wherein a controlled voltage source is applied to the capacitor 48, and gradually turned down. It is to be understood that the actual voltage does not vary along a straight line such as this, but will decrease by a very small increment each time overmodulation is detected, then will increase very gradually as the capacitor is recharged under normal modulation conditions.

Under the conditions that a stereo station is properly turned in and that no overmodulation is occurring, the voltage on the blend capacitor 48 will stay constant at about 3.6 volts. Full cosine $\phi$ correction and full stereophonic operation will be in effect. When overmodulation occurs and the voltage on the capacitor is reduced, the operating conditions remain unchanged until about the 3.0 V point is reached, when cosine correction will begin to shut down. By the 2.5 V point, there will be no more cosine correction, and the difference signal L−R will start to diminish. By the 2.0 V level, only the monophonic signal (L+R) will be coupled to the matrix 16, and the matrix outputs will each be L+R. This mode of operation will continue as the capacitor 48 voltage drops to a limiting value.

Figure 3:
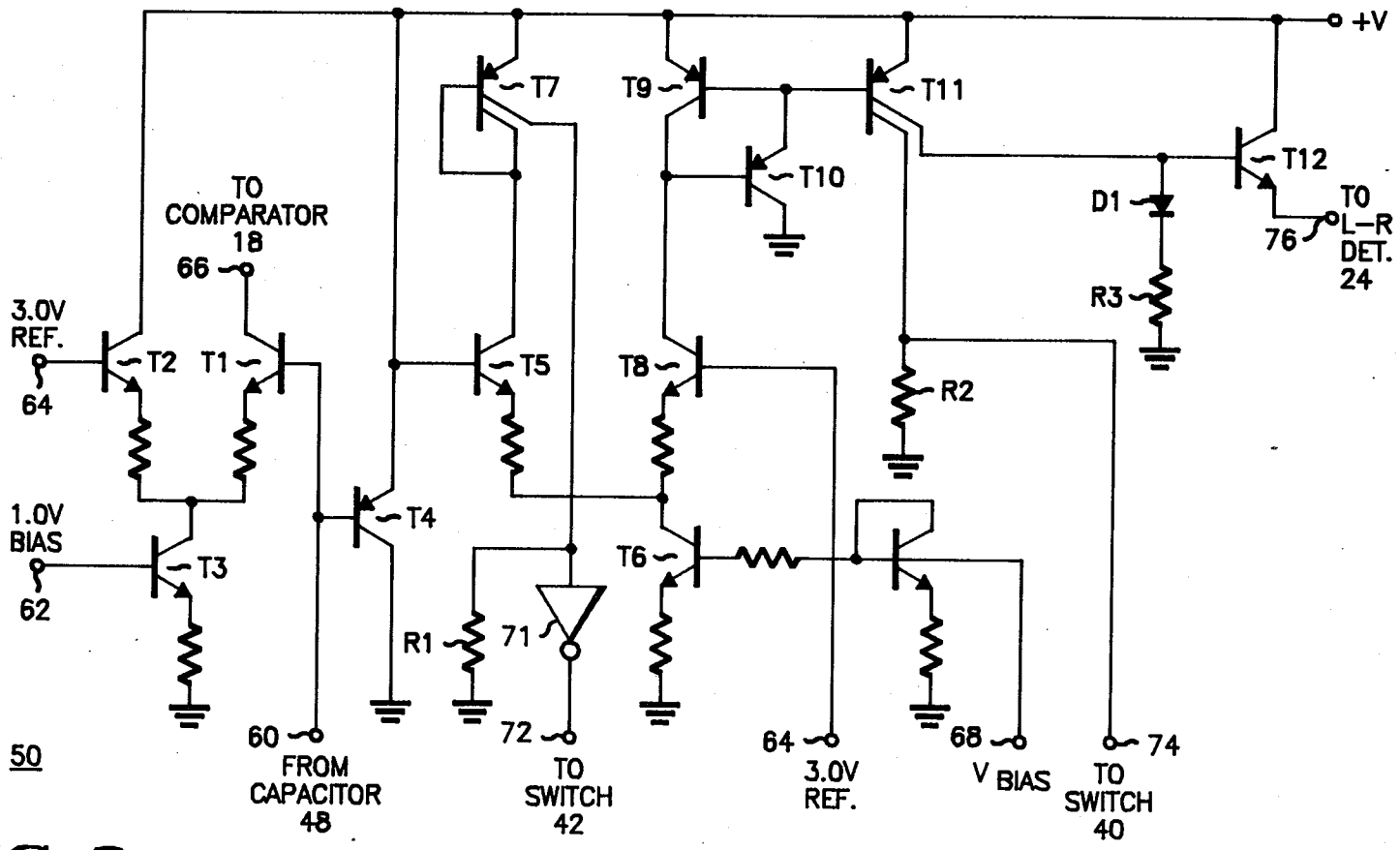
FIG. 3 is a schematic diagram of a portion of the embodiment of FIG. 1.

The schematic diagram of FIG. 3 illustrates one embodiment of the control circuit 50 of FIG. 1. The voltage on the blend capacitor 48, which is approximately 3.6 V normally, is coupled to the base of a transistor T1 via an input terminal 60. The base of a transistor T2 is coupled to a reference terminal 64 supplying a reference voltage of 3 V. A transistor T3, with a 1 V bias on its base from a terminal 62, provides all the current supplied through T1 to the comparator 18 circuit via a terminal 66. Comparator 18 is normally at maximum gain. As the capacitor 48 voltage drops below 3 V due to detection of overmodulation, the current through T1 is reduced, lowering the gain of the comparator 18 and reducing the amount of cosine correction in the divider 20.

With a capacitor 48 voltage of 3.6 V coupled to the base of a transistor T4, the emitter of T4 is at 4.3 V. With that voltage on the base of a transistor T5, the current supplied by a transistor T6 is coupled through T5 into one diode portion of a transistor T7. That current is mirrored through a second collector circuit of T7 and a resistor R1, whereby an inverter 71 has a logic high on the input, putting a low on an output terminal 72 which is coupled to control the switch 42. The switch 42 therefore stays closed until the 10% overmodulation point is reached. In the opposite side of this circuit, as the capacitor 48 voltage decreases, the current begins to flow through a transistor T8 and a beta-multiplied diode formed by transistors T9 and T10.

A current identical to that of T8 is mirrored through one collector circuit of a transistor T11 to its load resistor R2. The second collector circuit of T11 is coupled to a diode D1 and resistor R3 load, and to the base of a transistor T12 which determines the DC bias drive of the L−R detector 24. With 3.6 V on the capacitor 48, both resistors R2 and R3 have zero volts on them. Under conditions of heavy overmodulation, if the capacitor 48 voltage decreases to 2.5 V, the voltage across R2 reaches 0.7 V, opening switch 40. At this point (2.5 V), the voltage on the base of T12 begins to provide an output at the terminal 76 for reducing the current to the L−R detector 24. Assuming that the overmodulation continues, the capacitor voltage will go on down to 2 V, reducing the L−R detector drive to zero current and producing totally monophonic operation.

Thus there has been shown and described a control circuit for AM stereophonic receivers which will detect overmodulation in the received signal and respond appropriately to first reduce the amount of cosine correction utilized in the correction circuit, then, if the amount of overmodulation continues to increase, reduces the level of the difference signal. Other variations and modifications of the invention are possible and it is intended to cover all such as fall within the scope of the appended claims.

What is claimed is:

1. A control circuit as for use in an AM stereophonic receiver having input means for receiving an input signal consisting of a modulated carrier which is amplitude modulated by two signals, one in-phase and one in quadrature, and an in-phase synchronous detector means coupled to said input means for deriving a signal related to the in-phase modulation on said carrier, the circuit comprising:

comparator means coupled to said detector means for detecting negative amplitude overmodulation on said input signal and providing an output signal in response to at least one predetermined level of said overmodulation;

storage means coupled to said comparator means for storing a voltage which varies in response to the comparator output signal; and control means coupled to said storage means for gradual control of at least a blend function within said stereophonic receiver.

2. A control circuit in accordance with claim 1 wherein the receiver includes second detector means for deriving a second signal related to the quadrature modulation on said carrier and the control means includes means for varying the level of said second signal in response to the detected level of said negative amplitude overmodulation of said input signal, and the receiver further includes means for matrixing the signals from said first and second detector means.

3. A control circuit in accordance with claim 2 wherein the control means includes means for eliminating said second signal in response to a predetermined level of modulation of said input signal.

4. A control circuit in accordance with claim 1 and wherein said comparator means provides an output pulse at a first output terminal for each detection of negative amplitude overmodulation exceeding a first predetermined level.

5. A control circuit in accordance with claim 4 and further including switching means coupled between said first output terminal of said comparator and said storage means and enabled by said control means in response to the negative amplitude overmodulation of said input signal.

6. A control circuit in accordance with claim 4 and wherein said comparator means provides an output pulse at a second output terminal for each detection of negative amplitude overmodulation exceeding a second predetermined level and said second output terminal is coupled to said storage means separately from said first output terminal.

7. A control circuit in accordance with claim 6 and further including second switching means coupled between the second output terminal of said comparator and said storage means and enabled by said control means in response to the negative amplitude overmodulation of said input signal.

8. A control circuit as for use in an AM stereophonic receiver having input means for receiving an input signal consisting of a modulated carrier which is amplitude modulated by two signals, one in-phase and one in quadrature, an in-phase synchronous detector means coupled to said input means for deriving a signal related to the in-phase modulation on said carrier, means for providing a blend function and means for providing a correction signal for use in demodulating the input signal, the circuit comprising:

comparator means coupled to said detector means for detecting negative amplitude overmodulation on said input signal and providing an output signal in response to at least one predetermined level of said overmodulation;

storage means coupled to said comparator means for storing a voltage which varies in response to the comparator output signal; and control means coupled to said storage means and including means for gradual control of said blend function and means for varying the level of said correction signal, control of both functions being in response to the detected negative amplitude overmodulation of said input signal.

9. A control circuit in accordance with claim 8 wherein said control means further includes means for eliminating said correction signal at a predetermined level of said modulation.

10. An AM stereophonic receiver comprising:

input means for selectively receiving an AM stereophonic signal consisting of a carrier which is amplitude modulated by two signals, one in-phase and one in quadrature;

an in-phase synchronous detector means coupled to said input means for deriving a signal related to the in-phase modulation on said carrier;

comparator means coupled to said detector means for detecting negative amplitude overmodulation on said input signal and providing an output signal in response to at least one predetermined level of said overmodulation;

storage means coupled to said comparator means for storing a voltage which varies in response to the comparator output signal; and control means coupled to said storage means for gradual control of at least a blend function within said stereophonic receiver.

11. An AM stereophonic receiver as in claim 10 and including second detector means for deriving a second signal related to the quadrature modulation on said carrier, and wherein the control means includes means for varying the level of said second signal in response to the detected level of negative amplitude overmodulation of said input signal, and the receiver further includes means for matrixing the signals from said first and second detector means.

12. An AM stereophonic receiver as in claim 11 and wherein the control means includes means for eliminating said second signal in response to a predetermined level of negative amplitude overmodulation of said input signal.

13. An AM stereophonic receiver as in claim 10 and wherein said comparator means provides an output pulse at a first output terminal for each detection of negative amplitude overmodulation exceeding a first predetermined level and said first output terminal is coupled to said storage means.

14. An AM stereophonic receiver as in claim 13 and wherein said comparator means provides an output pulse at a second output terminal for each detection of negative amplitude overmodulation exceeding a second predetermined level and said second output terminal is coupled to said storage means separately from said first output terminal.

15. An AM stereophonic receiver comprising;

input means for selectively receiving an AM stereophonic signal consisting of a carrier, the carrier consisting of a carrier amplitude modulated by two signals, one in-phase and one in quadrature;

an in-phase synchronous detector means coupled to said input means for deriving a signal related to the in-phase modulation on said carrier;

comparator means coupled to said detector means for detecting negative amplitude overmodulation on said input signal and providing an output signal in response to at least one predetermined level of said overmodulation;

storage means coupled to said comparator means for storing a voltage which varies in response to the comparator output signal; and control means coupled to said storage means for gradual control of at least a blend function within said stereophonic receiver; and means for providing a correction signal for use in demodulating the input signal and wherein said control means includes means for varying the level of said correction signal in response to the detected negative amplitude overmodulation of said input signal.

16. An AM stereophonic receiver as in claim 15 and wherein said control means further includes means for eliminating said control signal at a predetermined level of said overmodulation.

* * * * *